US007780580B2

(12) United States Patent
Eschenbach

(10) Patent No.: US 7,780,580 B2
(45) Date of Patent: Aug. 24, 2010

(54) ARM EXERCISE APPARATUS FOR RUN SIMULATION

(76) Inventor: Paul William Eschenbach, 290 S. Tyger La., Roebuck, SC (US) 29376

( * ) Notice: Subject to any disclaimer, the term of this patent is extended or adjusted under 35 U.S.C. 154(b) by 583 days.

(21) Appl. No.: 11/645,315

(22) Filed: Dec. 26, 2006

(65) Prior Publication Data

US 2008/0153675 A1 Jun. 26, 2008

(51) Int. Cl.
*A63B 22/12* (2006.01)

(52) U.S. Cl. ..... 482/62; 482/52

(58) Field of Classification Search ..... 482/51, 482/52, 53, 57, 62, 70, 83, 148
See application file for complete search history.

(56) References Cited

U.S. PATENT DOCUMENTS 6,238,321 B1 5/2001 Arnold et al. ..... 482/52
6,422,976 B1 7/2002 Eschenbach ..... 482/52
7,025,711 B2 4/2006 Eschenbach ..... 482/52
7,270,625 B2 * 9/2007 Miller ..... 482/52
7,479,093 B1 * 1/2009 Immordino et al. ..... 482/52
2006/0199701 A1 9/2006 May et al. ..... 482/52
2006/0293153 A1 * 12/2006 Porth et al. ..... 482/52

* cited by examiner

*Primary Examiner*—Loan H Thanh
*Assistant Examiner*—Tam Nguyen

(57) ABSTRACT

An arm exercise apparatus simulates the arm movements of running and jogging. The arm exercise apparatus is coordinated with the foot motion of several typical elliptical cross trainers. Each handle is guided by a pair of links to move from along side an operator, engaged on the apparatus, forward and toward the sagittal plane of the operator to simulate the arm movement of running and jogging. An adjustment is provided to vary the handle movement.

20 Claims, 5 Drawing Sheets

ARM EXERCISE APPARATUS FOR RUN SIMULATION

BACKGROUND OF THE INVENTION

1. Field

The present invention relates to an arm exercise apparatus that simulates the arm movements of running and jogging. More particularly, the present invention is associated with an exercise machine having separately supported pedals for the feet combining coordinated arm exercise with the motion of the feet.

2. State of the Art

The benefits of regular exercise to improve overall health, appearance and longevity are well documented in the literature. For exercise enthusiasts the search continues for safe apparatus that provides total body exercise for maximum benefit in minimum time.

Elliptical cross trainers guide the feet through generally elliptical paths on pedals having pedal angles controlled to simulate the foot motion during running and jogging. Typical rear drive cross trainers with arm exercise are found in Eschenbach U.S. Pat. No. 7,025,711 and Arnold et al. U.S. Pat. No. 6,238,321. A front drive cross trainer with arm exercise is shown in Eschenbach U.S. Pat. No. 6,422,976. The handles used for arm exercise typically rotate back and forth coordinated with the elliptical foot motion. Hand grips are generally positioned on the handle to move back and forth at shoulder height. A study of the hand motion of someone free running shows that the hand motion begins on the side of a runner around the hip region moving forward and towards the sagittal plane of the runner while the foot on the other side of a free runner moves to the rear. The motion of shoulder height hand grip handles are not even close to the proper free running hand motion desired. May et al. in U.S. Pat. Application No. 2006/0199701 provides an independent inclined hand movement as some improvement over the rotary handle.

There remains a need to more accurately simulate the hand movements common to running and jogging in conjunction with the foot motion of an elliptical device. There also remains a need for an exercise apparatus that provides adjustable running hand motion to suit the operator.

SUMMARY OF THE INVENTION

The present invention relates to the kinematic motion control of handles which simulate running during operation. More particularly, apparatus is provided that offers running hand motion coordinated with the foot motion of elliptical cross trainers.

In the preferred embodiment, the apparatus includes a pair of handles each having a hand engaging grip supported by a pair of linkage systems that guides each hand grip along inclined arcuate paths. Each linkage system is comprised of a first link and a second link, each link pivotally connected to the handle and a frame. Hand motion begins on the side of an operator near the hip region and moves forward towards the sagittal plane of the operator or apparatus. The frame pivots for the second links are closer together than the frame pivots for the first links to cause hand grip movement forward towards the sagittal plane of an operator.

Each handle contains a pivot allowing the hand grip to rotate towards the center of an operator. A coupler link is pivotally connected to each handle and first link to control the amount of rotation. Adjustment is provided to change the amount of rotation to suit an operator. Each linkage system is coordinated with the pedal movements of a foot driven exercise device by connecting links. The arm exercise apparatus delineated herein can also be applied to other foot exercise devices such as steppers, treadclimbers, stationary bikes, etc.

In summary, this invention provides the operator with arm exercise closely simulating the natural arm movements in free running. Moreover, the arm motion is coordinated with the foot motions of a foot driven exercise device.

BRIEF DESCRIPTION OF THE DRAWINGS

The foregoing and other objects and features of the present invention will become more fully apparent from the following description and claims, taken in conjunction with the drawings. Understanding that these drawings depict only typical embodiments of the invention and are, therefore, not to be considered limiting of its scope or combinations, the invention will be described with additional specificity and detail through use of the accompanying drawings in which:

DETAILED DESCRIPTION OF THE EMBODIMENT

Figure 1:
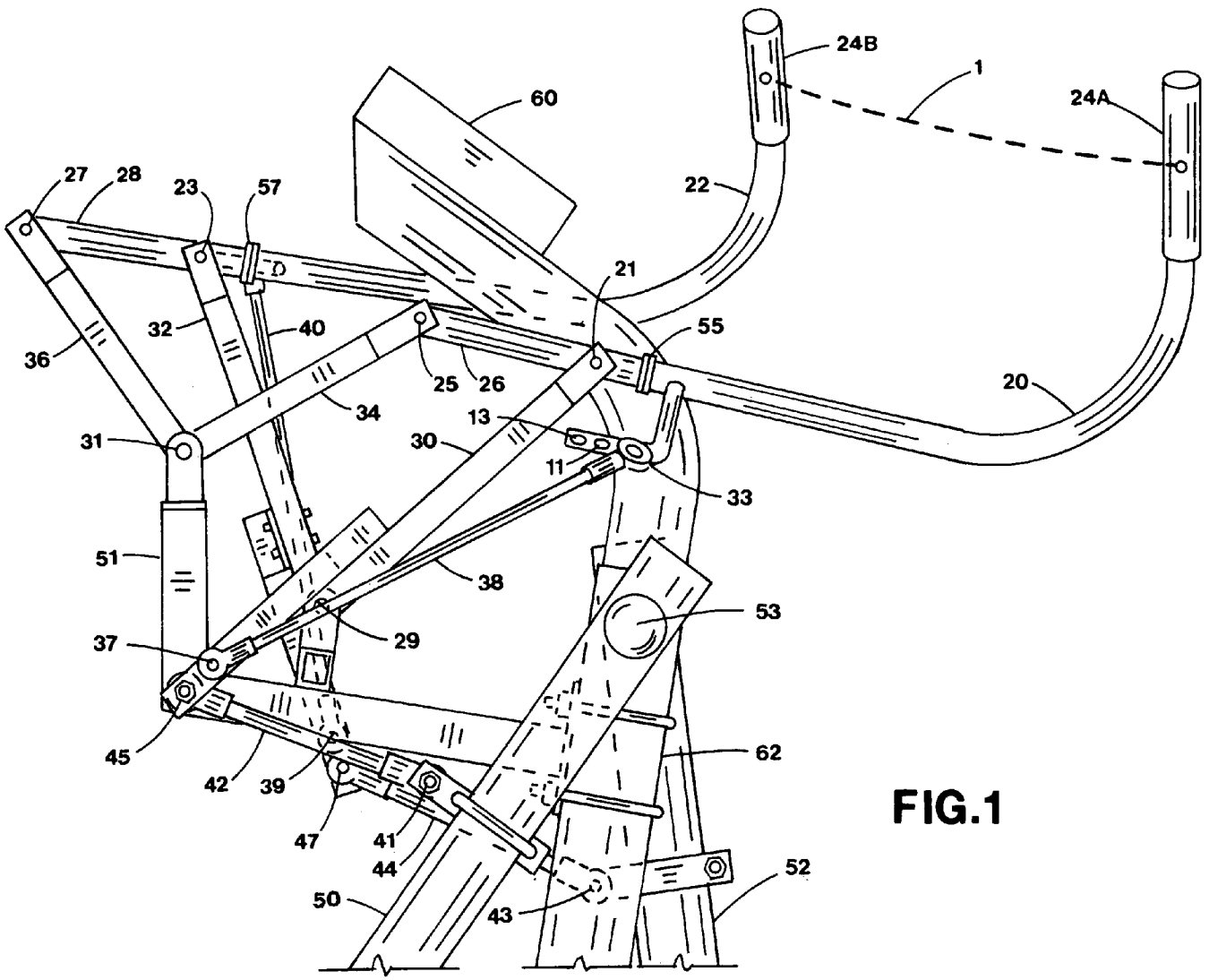
FIG. 1 is a left side elevation view of the preferred embodiment of an arm exercise apparatus constructed in accordance with the present invention.
Figure 2:
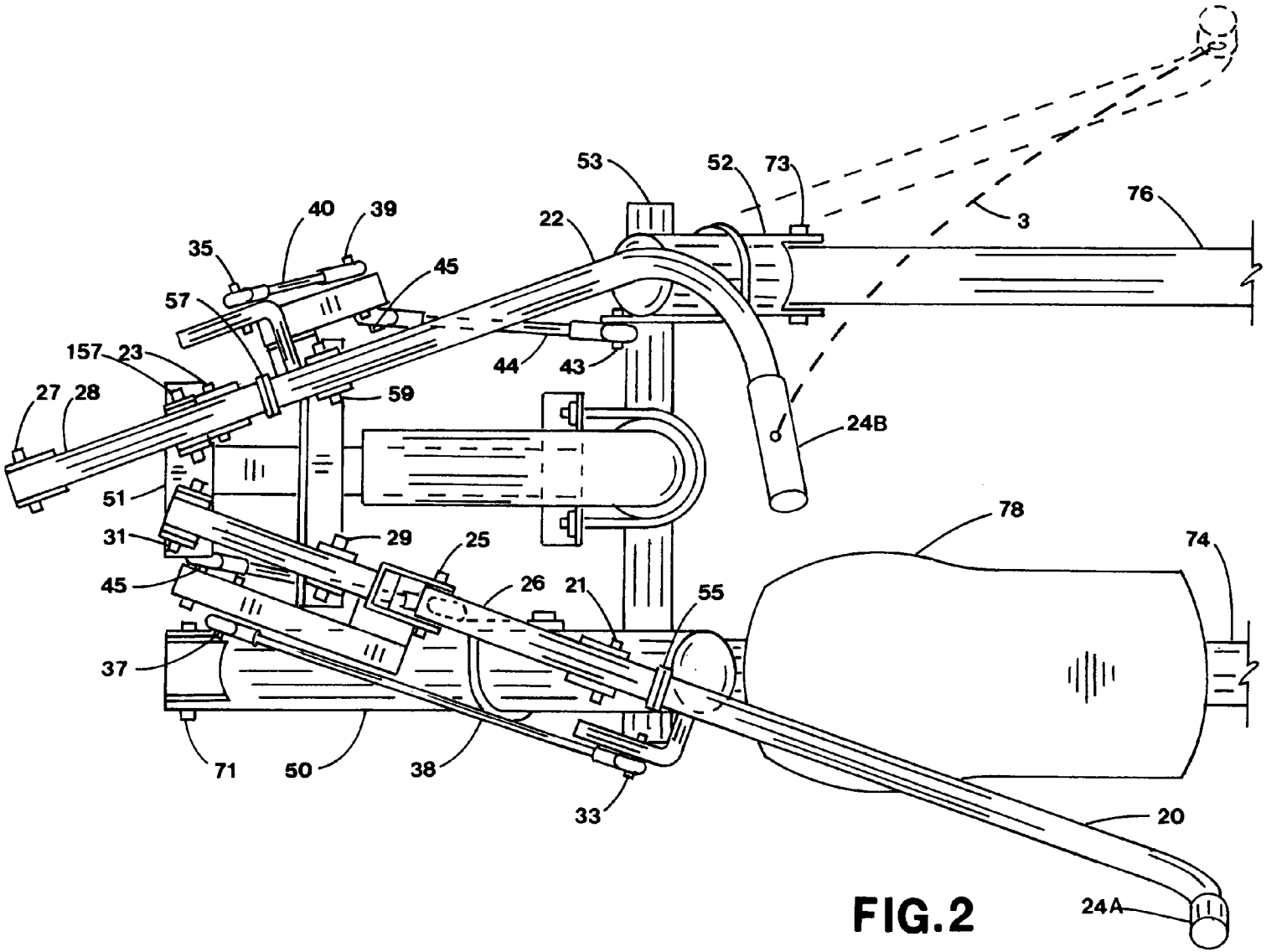
FIG. 2 is the plan view of the preferred embodiment shown in FIG. 1.

Referring to the drawings in detail, handles 20,22 are shown in FIGS. 1 and 2 in the most rearward and forward positions of the preferred embodiment. Hand grip 24*a* is positioned along side the operator in the hip region. Hand grip 24B is forward the operator and close to the center of the operator. Curve paths 1 and 3 show the route hand grips 24*a*,24*b* take between the end positions.

Handles 20,22 are connected to handle extensions 26,28. First links 30,32 are connected to handle extensions 26,28 at pivots 21,23. Second links 34,36 are connected to handle extensions 26,28 at pivots 25,27. First links 30,32 are connected to framework member 51 at pivots 29 and 59 while second links 34,36 are connected to framework member 51 at pivots 31 and 157. Note that pivots 31 and 157 are closer together than pivots 29 and 59 as shown in FIG. 2. The separation difference cause handles 20,22 to move from the side of the operator across the front of the operator towards the sagittal plane of an operator to simulate the hand motion of running as shown by hand grip curve 3 in FIG. 2.

Pivots 55,57 are positioned between handles 20,22 and handle extensions 26,28 as an option to allow rotation of hand grips 24,26. Control links 38,40 are connected to handles 20,22 at pivots 33,35 and to first links 30,32 at pivots 37,39. Adjustment holes 11,13 on handles 20,22 allow repositioning of control links 38,40 to change the amount of hand grip 24*a*,24*b* rotation. As shown in FIG. 2, the control link 40 accounts for about half the movement of hand grip 26 from along side the body to the most forward position at the end of curve path 3.

Connecting links 42,44 are connected to first links 30,32 at pivots 45,47 and to rocker links 50,52 at pivots 41,43. Rocker links 50,52 are connected to frame member 62 at pivot 53.

Figure 3:
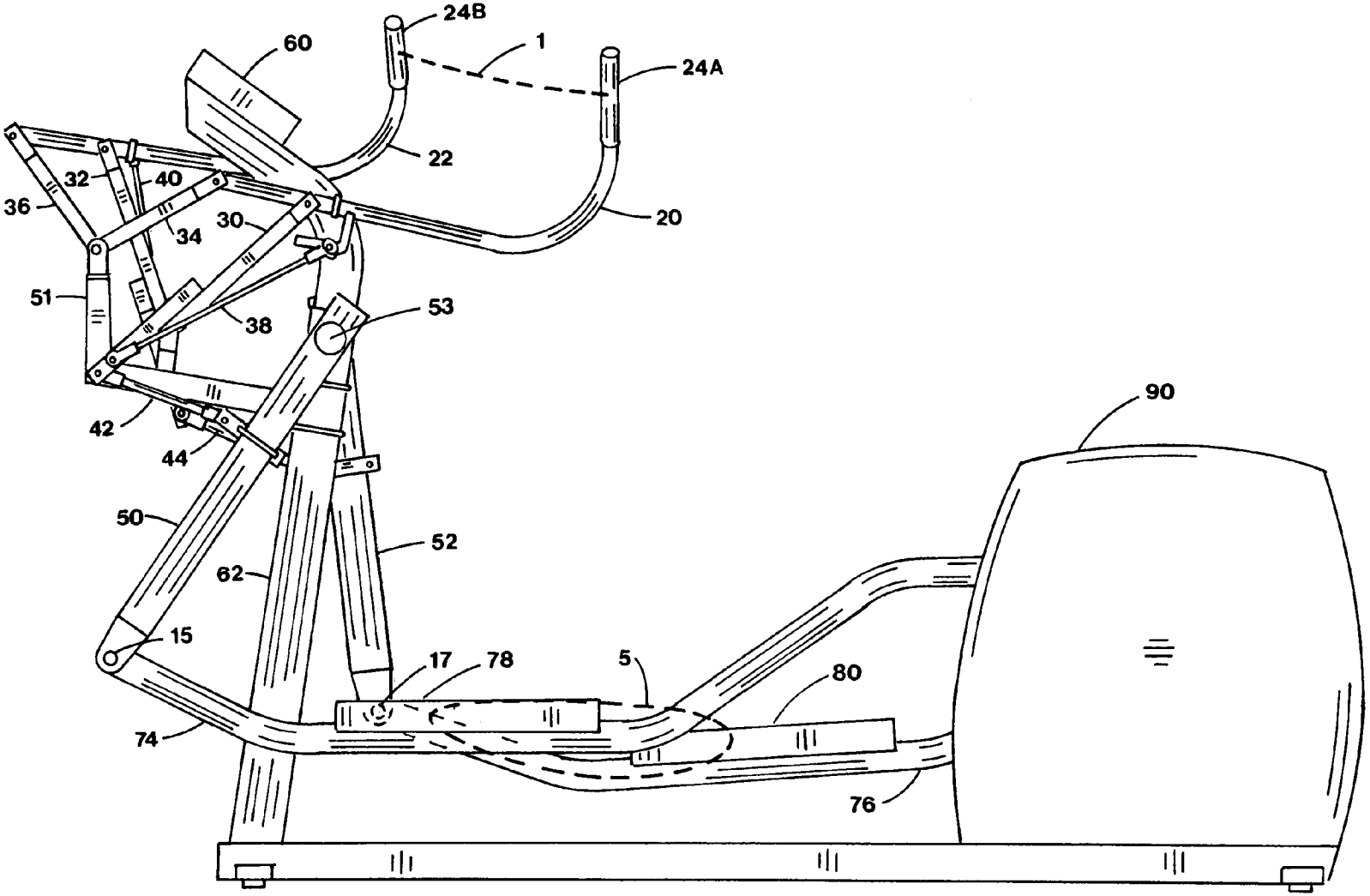
FIG. 3 is a left side view of the preferred embodiment of FIGS. 1 and 2 coordinated with a rear drive exercise device having rockers as foot member supports.

FIG. 3 shows a rear drive 90 cross trainer having pedals 78,80 which follow the elliptical path 5. Foot support members 74,76 support pedals 78,80 and are connected to rocker links 50,52 at pivots 15,17. The arm exercise apparatus shown in FIGS. 1 and 2 is shown in FIG. 3 with the motion of handles 24,26 coordinated with foot pedals 78,80. Control display 60 is attached to frame member 62. Frame member 51 is attached to frame member 62.

Figure 4:
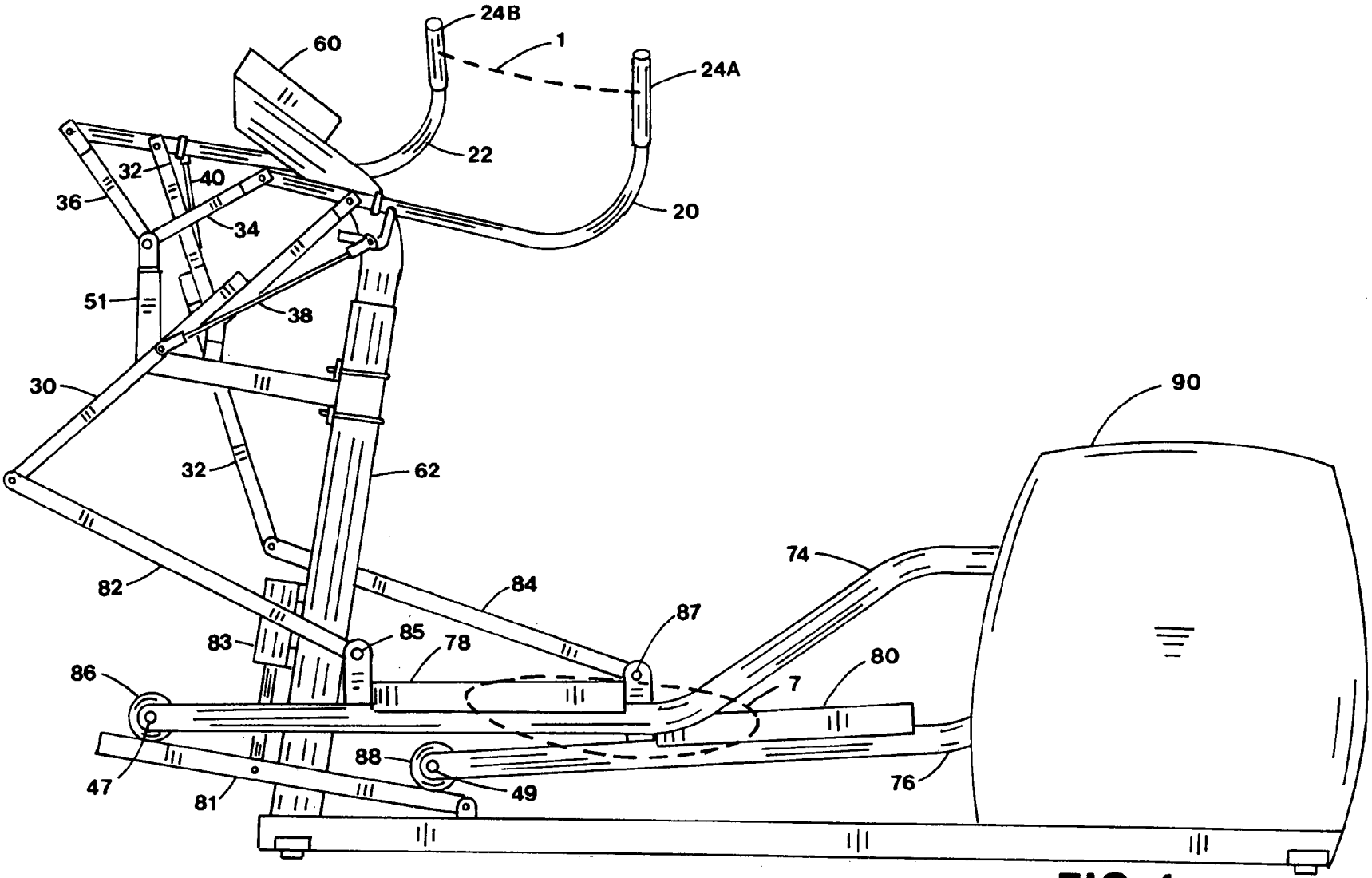
FIG. 4 is a left side view of the preferred embodiment of FIGS. 1 and 2 coordinated with a rear drive exercise device having rollers as foot member supports.

FIG. 4 shows a rear drive 90 cross trainer having pedals 78,80 which follow the elliptical path 7. Foot support members 74,76 support pedals 78,80 and are connected to rollers 86,88 at pivots 47,49. Rollers 86,88 ride on ramp 81 which is adjustable by actuator 83. The arm exercise apparatus shown in FIGS. 1 and 2 is shown in FIG. 4 with the motion of handles 24,26 coordinated with foot pedals 78,80 by connecting links 82,84 at pivots 85,87. Control display 60 is attached to frame member 62. Frame member 51 is attached to frame member 62.

Figure 5:
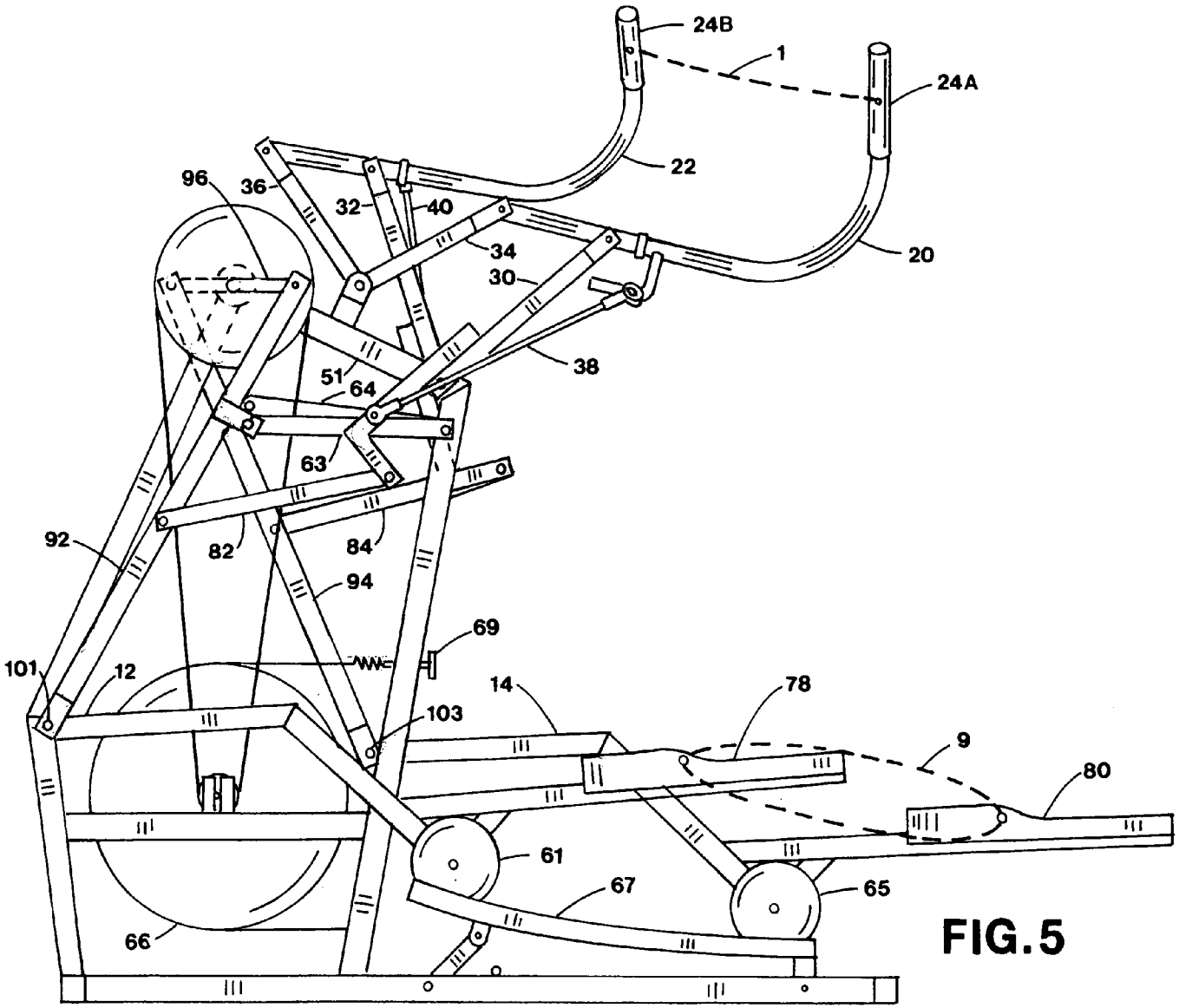
FIG. 5 is a left side view of the preferred embodiment of FIGS. 1 and 2 coordinated with a front drive exercise device.

FIG. 5 shows a front drive cross trainer having pedals 78,80 which follow the elliptical path 9. Foot support members 12,14 support pedals 78,80 and are connected to drive links 92,94 at pivots 101,103. Rollers 61,65 ride on ramp 67. Crank 96 and couplers 63,64 complete the front drive. Adjustment knob 69 will vary the intensity of arm exercise through a friction drag on flywheel 66. The arm exercise apparatus shown in FIGS. 1 and 2 is shown in FIG. 5 with the motion of handles 24,26 coordinated with foot pedals 78,80 by connecting links 82,84 connected to drive links 92,94.

By previous examples, the preferred embodiment of the arm exercise apparatus of the present invention is shown coordinated with three different types of elliptical cross trainers. The arm exercise apparatus may also be coordinated with other foot driven exercise devices not shown here.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise apparatus configured for arm exercise comprising;

a framework, said framework configured to support said exercise apparatus;

a pair of linkage systems, each said linkage system operatively associated with said framework;

a pair of handle extensions, each said handle extension operably associated with a respective said linkage system;

a pair of handles for arm exercise, each said handle rotatably associated with a respective said handle extension about an axis positioned parallel to the lenath of said handle extension;

a pair of control links, each said control link pivotally connected to a respective said handle and a respective said linkage system to orient said handle position;

said handles alternately moving forward from the side of an operator engaged to exercise on the exercise apparatus, while rotating inward, towards the sagittal plane of said exercise apparatus when said operator applies force to said handles to simulate the arm movement of running and jogging.

2. The exercise apparatus according to claim 1 wherein said linkage system is comprised of a pair of first links, each said first link pivotally connected to a respective handle extension and to said framework, and a pair of second links, each said second link pivotally connected to the same handle extension and to said framework.

3. The exercise apparatus according to claim 1 further comprising a foot driven exercise device, said foot driven exercise device operatively associated with said exercise apparatus.

4. The exercise apparatus according to claim 3 further comprising a pair of connecting links, each said connecting link pivotally connected to said linkage system and said foot driven exercise apparatus to coordinate said arm exercise with the foot motion of said foot driven exercise device.

5. The exercise apparatus according to claim 3 wherein said foot driven exercise device has a pair of pedals for the feet of an operator which follow an elliptical curve path.

6. The exercise apparatus according to claim 3 wherein said foot driven exercise device has foot support members guided by a pair of rocker links configured in a rear drive exercise device.

7. The exercise apparatus according to claim 3 wherein said foot driven exercise device has foot support members guided by a pair of rollers configured in rear drive exercise device.

8. The exercise apparatus according to claim 3 wherein said foot driven exercise device has foot support members guided by a pair of links configured in a front drive exercise device.

9. The exercise apparatus according to claim 1 further comprising an adjustment device, said adjustment device operatively associated with said control link to change the amount of said handle rotation.

10. An exercise apparatus configured for arm exercise comprising;

a framework, said framework configured to support said exercise apparatus;

a pair of first links, each said first link pivotally connected to said framework;

a pair of second links, each said second link pivotally connected to said framework;

a pair of handle extensions, each said handle extension pivotally connected to a respective first and second links;

a pair of handles for arm exercise, each said handle attached to a respective handle extension having a hand grip positioned generally perpendicular to and distal said handle extension;

said hand grips alternately moving forward from the sides of an operator, engaged to exercise on the exercise apparatus, towards the sagittal plane of said exercise apparatus following a path having a varying radius of curvature when said operator applies force to said handles to simulate the arm movement of running and jogging.

11. The exercise apparatus according to claim 10 further comprising a foot driven exercise device, said foot driven exercise device operatively associated with said exercise apparatus.

12. The exercise apparatus according to claim 11 wherein said foot driven exercise device has a pair of pedals for the feet of an operator which follow an elliptical curve path.

13. The exercise apparatus according to claim 10 further comprising a pair of control links, each said control link pivotally connected to a respective said handle and said first link to cause the hand of said operator to rotate from one side towards the other side of said exercise apparatus when said handle moves forward.

14. The exercise apparatus according to claim 11 further comprising a pair of connecting links, each said connecting link pivotally connected to said first link and said foot driven exercise apparatus to coordinate said arm exercise with the foot motion of said foot driven exercise device.

15. An exercise apparatus configured for arm exercise comprising;

a framework, said framework configured to support said exercise apparatus;

a pair of first links, each said first link pivotally connected to said framework at an intermediate portion of said first link;

a pair of second links, each said second link pivotally connected to said framework;

a pair of handle extensions, each said handle extension pivotally connected to a respective first and second links;

a pair of handles for arm exercise, each said handle attached to a respective handle extension having a hand grip positioned generally perpendicular to and distal said handle extension;

a pair of connecting links, each said connecting link pivotally connected to a respective said first link at one end distal said handle extension and operatively associated with a foot driven exercise device;

said hand grips alternately moving forward from the side of an operator, engaged to exercise on the exercise apparatus, towards the sagittal plane of said exercise apparatus following a path having a varying radius of curvature when said operator applies force to said handles to simulate the arm movement of running.

16. The exercise apparatus according to claim 15 wherein said foot driven exercise device has a pair of pedals for the feet of an operator which follow an elliptical curve path.

17. The exercise apparatus according to claim 15 wherein said foot driven exercise device has foot support members guided by a rear drive exercise device.

18. The exercise apparatus according to claim 15 wherein said foot driven exercise device has foot support members guided by a front drive exercise device.

19. The exercise apparatus according to claim 14 further comprising a pair of control links, each said control link pivotally connected to a respective said handle and operatively associated with a respective said first link to cause the hand of said operator to rotate from one side towards the other side of said exercise apparatus when said handle moves forward.

20. The exercise apparatus according to claim 19 further comprising an adjustment device, said adjustment device operatively associated with said control link to change the amount of said handle rotation.

* * * * *